United States Patent [19]

Hiramatsu et al.

[11] Patent Number: 4,843,985

[45] Date of Patent: Jul. 4, 1989

[54] APPARATUS FOR TURNING OVER A GARMENT FLAP

[75] Inventors: Tooru Hiramatsu, Fuchu City; Shigeru Tobita, Chofu City, both of Japan

[73] Assignee: Juki Corporation, Japan

[21] Appl. No.: 160,572

[22] Filed: Feb. 26, 1988

[30] Foreign Application Priority Data

Feb. 27, 1987 [JP] Japan ..... 62-46507

[51] Int. Cl.[4] ..... D05B 35/00

[52] U.S. Cl. ..... 112/147; 112/104; 112/113

[58] Field of Search ..... 112/147, 136, 153, 70, 112/76, 77, 104, 114, 113, 110, 112, 121.26, 121.27, 121.29

[56] References Cited

U.S. PATENT DOCUMENTS

| | | | |
|---|---|---|---|
| 3,750,604 | 8/1973 | Carrel et al. | 112/70 X |
| 4,034,689 | 7/1977 | Hintzen | 112/70 X |
| 4,562,782 | 1/1986 | Doucette et al. | 112/104 |
| 4,580,512 | 4/1986 | Nakatani et al. | 112/147 |
| 4,606,287 | 8/1986 | Papajewski et al. | 112/121.27 |
| 4,648,335 | 3/1987 | Hiramatsu et al. | 112/114 |

FOREIGN PATENT DOCUMENTS

| | | | |
|---|---|---|---|
| 45-20010 | 7/1970 | Japan . | |
| 55-46341 | 11/1980 | Japan . | |
| 56-17068 | 2/1981 | Japan . | |
| WO/02675 | 5/1986 | PCT Int'l Appl. | 112/47 |

*Primary Examiner*—H. Hampton Hunter

*Attorney, Agent, or Firm*—Morgan & Finnegan

[57] ABSTRACT

An apparatus installed on a sewing machine for automatically turning over a garment flap during zipper stitching first descends such that a flap lever which turns the flap over is positioned closely beside the flap, and second the flap lever is rotated laterally. The flap lever securely turns over the flap without being lifted unnecessarily higher, and the initial position of the flap lever is high enough to not obstruct the setting work of workpiece. A pneumatic cylinder successively causes the above described actions.

4 Claims, 9 Drawing Sheets

APPARATUS FOR TURNING OVER A GARMENT FLAP

FIELD OF THE INVENTION

This invention relates to an apparatus for automatically turning over a flap which is arranged to cover a zipper attached to a garment, and more particularly to a mechanical way of securely turning over the flap so that the flap may not be returned during the zipper stitching process.

BACKGROUND OF THE INVENTION

A general stitching technique for attaching a zipper tape $f_t$ to a garment W will be explained.

This technique is best understood by referring to FIG. 4. When stitching lines $S_1$, $S_2$ are finished, some kind of a lever is required to turn over flap $W_f$ such that stitch line $S_3$ will be exposed during stitching.

One conventional way of turning over the flap will be explained with reference to FIGS. 5A and 5B. When the stitch lines $S_1$, $S_2$ (FIG. 4) are finished, rod a is pulled in the direction of arrow A in FIG. 5B by some driving source (not shown), so that link b pivoted to rod a rotates counter-clockwise around shaft c and consequently lever d rotates clockwise around shaft e. Since shaft e is slidably inserted in the oblong hole $d_1$ provided at the lever d, the tip $d_2$ of lever d traces a parabolic curve $E_p$ as shown in FIG. 5*b*.

In a conventional flap-turning apparatus, the tip $d_2$ rotates around shaft e as shown in FIG. 6.

The radius of rotation when the tip $d_2$ moves to its lowest position at O is $R_o$.

The radius of rotation when the tip $d_2$ is positioned as shown in FIG. 6 is $R_1$. The rotating radius decreases as the tip $d_2$ moves laterally, so the tip $d_2$ tends to take an unnecessarily high position when it moves laterally. Because of this, when the garment material is soft, the flap $W_f$ tends to escape from the tip $d_2$.

SUMMARY OF THE INVENTION

With the foregoing in mind, it is an object of this invention to provide an improved apparatus for turning a flap in a garment to be sewn.

Normally, the stitching of stitch line $S_3$ (FIG. 4) is obstructed by the flap. Thereby, it is advisable to lower the height h of tip $d_2$ in relation to the lateral movement t.

However, if $R_1$ is kept the same as $R_o$ by some mechanism, the initial position $d_2$ will be too low and the setting work of the workpiece will be obstructed by the tip $d_2$.

According to the present invention, the lever which turns the flap over is first lowered so that its tip is almost touching the surface of garment, and next, the lever is rotated laterally. Thus, the tip of the lever will not take an unnecessarily high position. Two mechanisms are symmetrically arranged as shown in FIG. 3D to securely open the flap $W_f$. One mechanism is employed to turn the flap $W_f$ over leftwardly, and the other mechanism is employed to turn the flap $W_f$ over rightwardly.

According to the present invention, the lever which turns the flap over during the setting work of the workpiece is lifted high enough to not obstruct the setting work. This prevents any obstruction of the workpiece and facilitates the setting work. The turning action of the lever begins only after the lever has descended low enough to touch the surface of the garment.

During the turning action the tip of the lever traces a circular curve, keeping one predetermined point for its center, so that the tip of the lever will not be lifted as high as the tip in a conventional device. Therefore the flap will be turned over more securely.

In the preferred embodiment a pneumatic cylinder is used as the driving source for this mechanism, but an electrically operated solenoid or other actuators can be used.

BRIEF DESCRIPTION OF THE DRAWINGS

The accompanying drawings, referred to herein and constituting a part hereof, illustrate a preferred embodiment of the invention and, together with the description, serve to explain the principles of the invention, wherein:

FIGS. 3A–3C illustrate stepwise operation of the present invention. FIG. 3A shows the position when the invention is not operating. FIG. 3B shows the flap lever descending. FIG. 3C shows the flap lever after rotation. FIG. 3D is a front view along the direction of arrow P in FIG. 2.

FIGS. 5 and 6 are front views of a conventional apparatus for turning over a garment flap according to the prior art.

FIG. 6 is a partially enlarged view of FIGS. 5A and 5B.

DETAILED DESCRIPTION OF THE DRAWINGS

Figure 1:
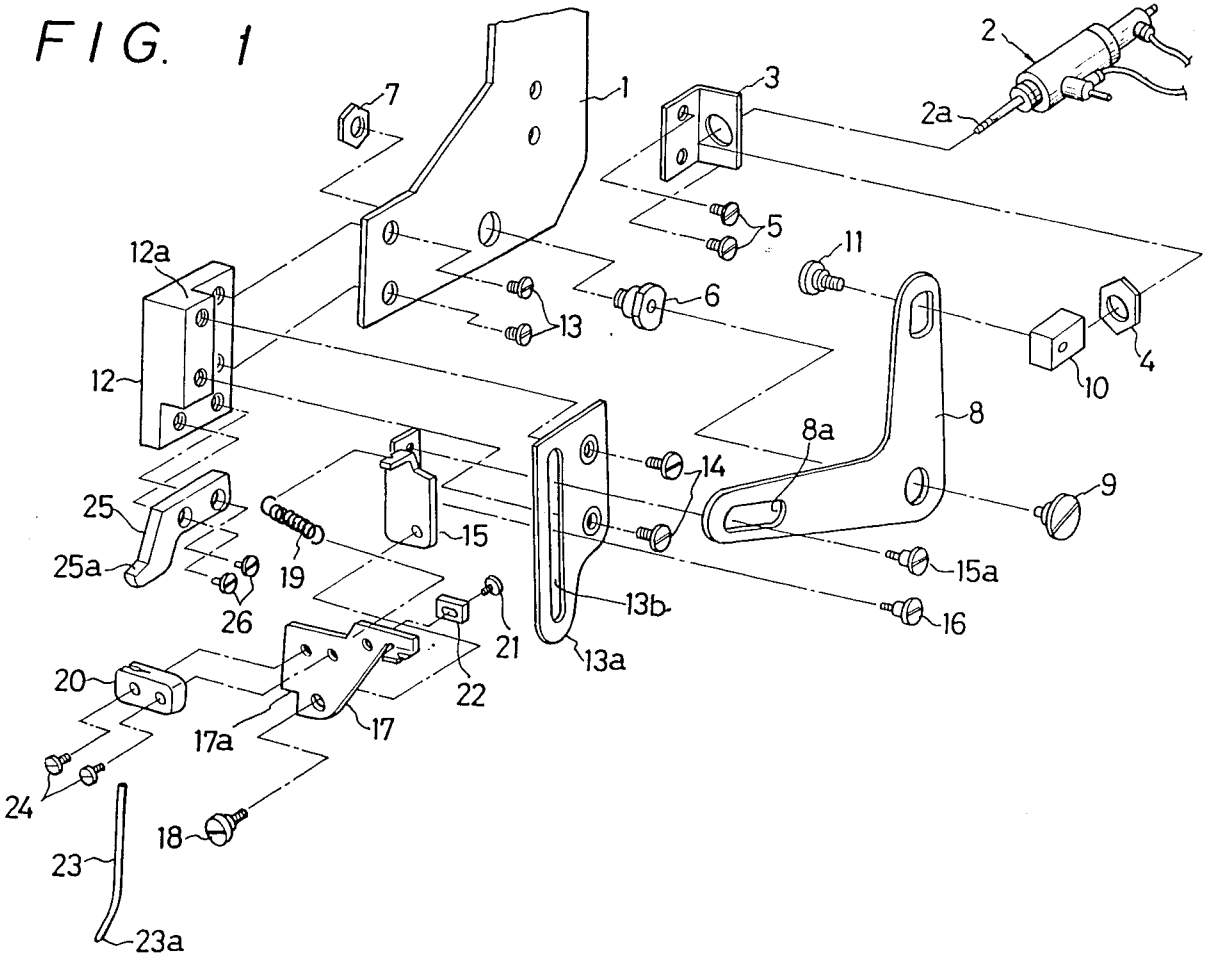
FIG. 1 is a perspective exploded view of one embodiment of an apparatus for turning over a garment flap according to the present invention. Only the right half is shown because the left half is summetrically identical.

Referring to the accompanying FIGS. 1–3, one preferred embodiment of the present invention will be explained.

Line N indicates a needle position. Numeral 1 denotes a set-plate which supports an apparatus in accordance with the present invention for turning over a garment flap. This set-plate 1 is fixed to an arm portion of a sewing machine. Numeral 2 denotes a pneumatic cylinder which is fixed to a cylinder holder 3 by nut 4. The cylinder holder 3 is fixed to the set-plate 1 by screws 5. Numeral 6 denotes a screw-shaft which is fixed to the set-plate 1 by nut 7. Numeral 8 denotes a drive lever that is L-shaped. Its center portion pivots about the end of the screw shaft 6. Step-screw 9 secures the drive lever such that it can rotate about the step screw 9. One end of drive lever 8 is connected to an end 2*a* of the pneumatic cylinder 2 by cylinder knuckle 10, step screw 11 and nut 4, such that drive lever 8 rotates counter-clockwise when the pneumatic cylinder 2 expands. Numeral 12 denotes a guide setting plate that is fixed to the backside of set plate 1 by screws 13. Its projecting portion 12*a* fixes guide plate 13*a* by screws 14. Guide plate 13*a* contains an oblong hole 13*b*. Numeral 15 denotes a slider connected to the end of drive lever 8 by step screw 15*a* which passes through oblong hole 13*b*. Step screw 16 is screwed into the slider 15 passing through oblong hole 13*b*.

Thereby, when pneumatic cylinder 2 expands, the drive lever 8 rotates counter clockwise, and the slider 15 slides down along the oblong hole 13*b*.

Numeral 17 denotes a drive plate which is rotatably connected to slider 15 by step screw 18. Numeral 19 denotes a spring which urges the drive plate 17 to rotate counter-clockwise around the step screw 18.

Numeral 22 denotes a stopper which restricts the counter-clockwise rotation of guide plate 17 and is fixed to the back side of the guide plate 17 by screw 21. Numeral 20 denotes a lever holder fixed to guide plate 17 by screws 24. Lever holder 20 holds the upper portion of a flap lever 23 which turns the flap over. Numeral 25 denotes another stopper fixed to the lower portion of the guide setting plate 12 by screws 26. The tip 25*a* of the stopper 25 positions so as to engage a corner recess 17*a* of drive plate 17 when drive plate 17 descends as shown in FIG. 3B.

Figure 3A:
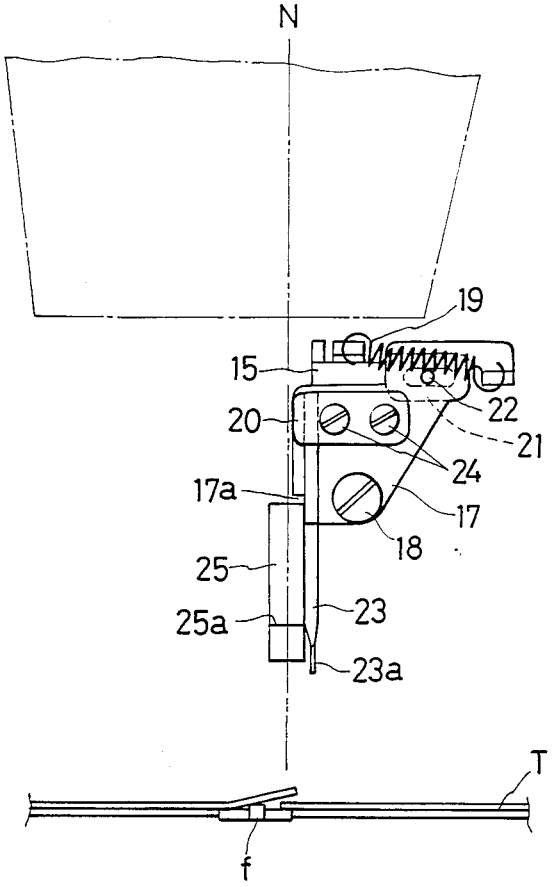
FIGS. 3A–3D are front view drawings of the view along arrow P in FIG. 2.
Figure 3B:
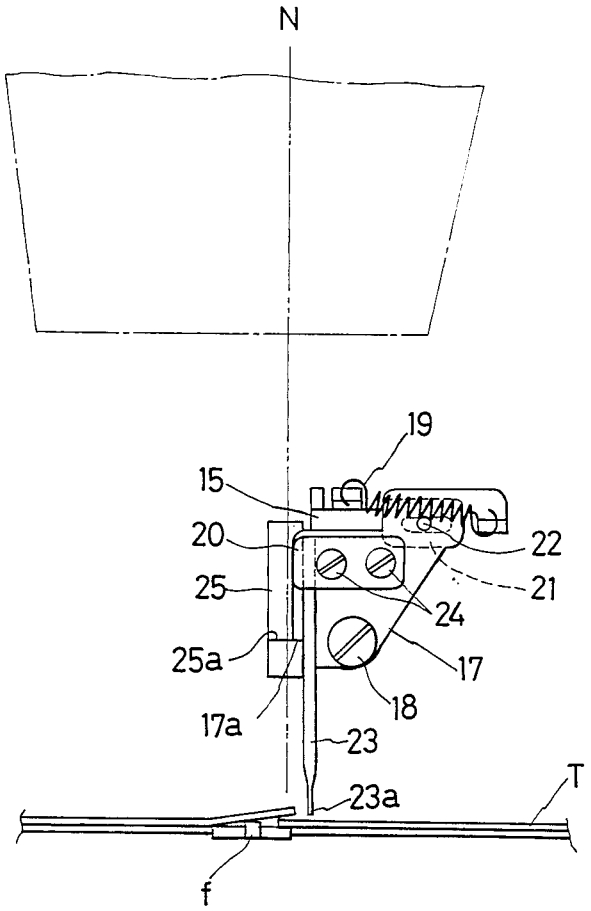
Figure 3C:
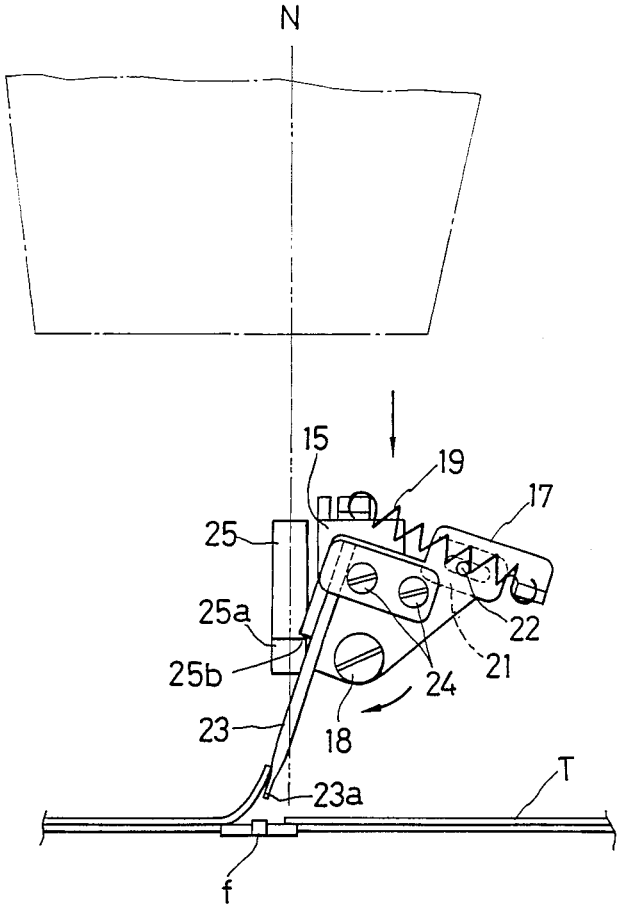
Figure 3D:
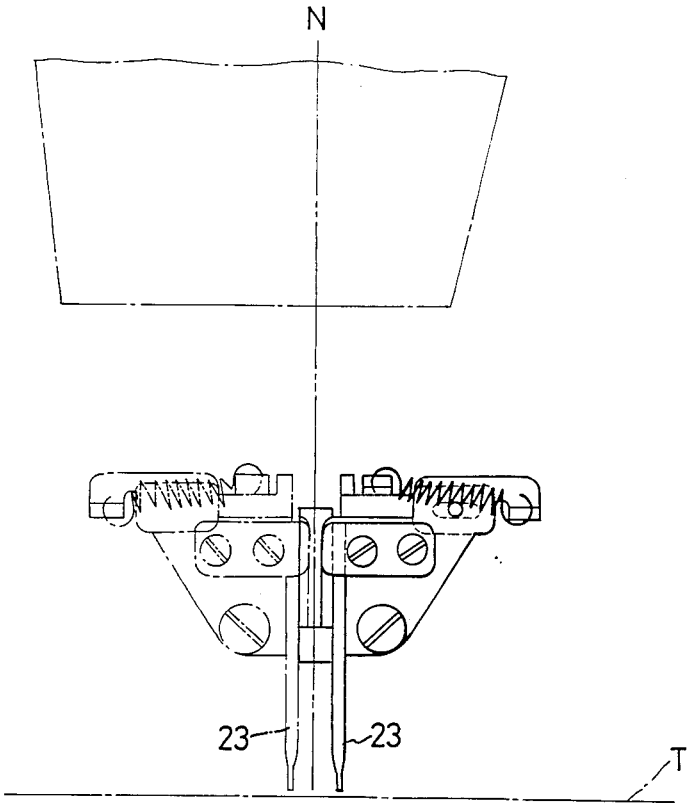

As drive plate 17 descends further the flap lever 23 rotates around contact point 25*b* between tip 25*a* and drive plate 17 as shown in FIG. 3C.

Operation of the presently-described apparatus will now be explained.

Figure 4:
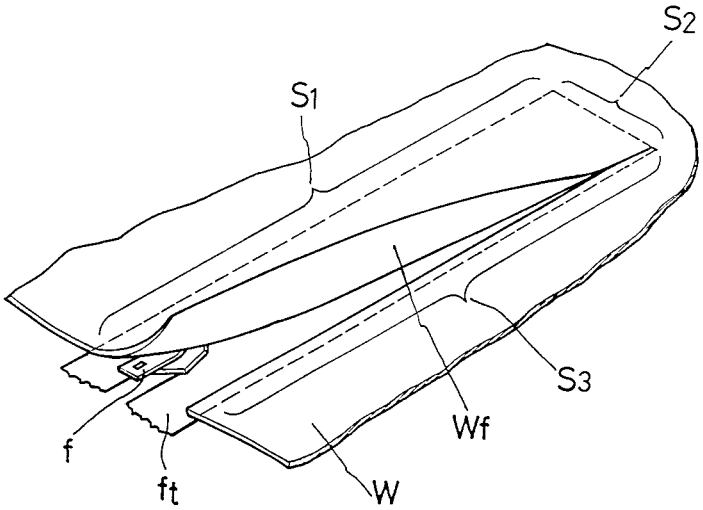
FIG. 4 shows generally how a zipper with a flap is sewn to a garment.
Figure 5A:
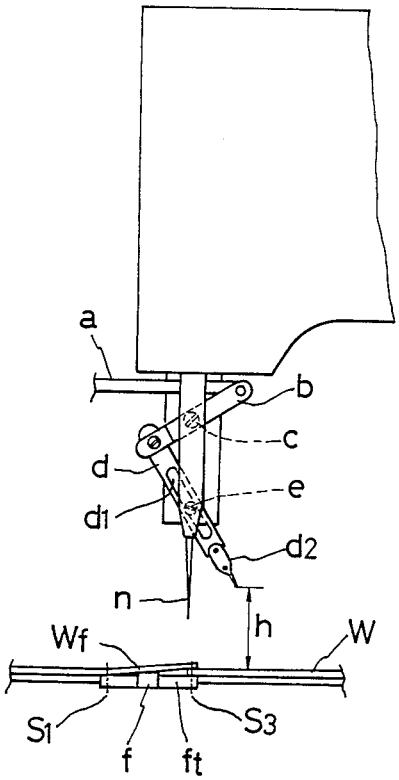
FIG. 5A (PRIOR ART)
FIG. 5A shows when a flap lever is ready to start moving the flap.
Figure 5B:
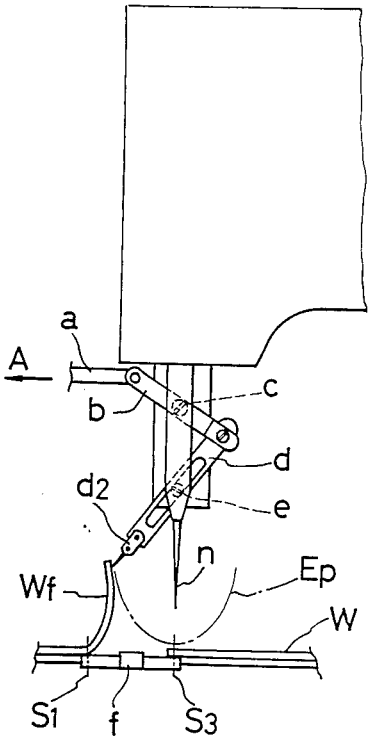
FIG. 5B (PRIOR ART)
FIG. 5B shows when a flap lever has turned the flap over.

During zipper stitching work along lines $S_1$, $S_2$ and $S_3$, as shown in FIG. 4, the pneumatic cylinder 2 remains in its normal position until the stitch line $S_2$ is finished. Drive plate 17 is positioned above the tip 25*a* of stopper 25.

Figure 2:
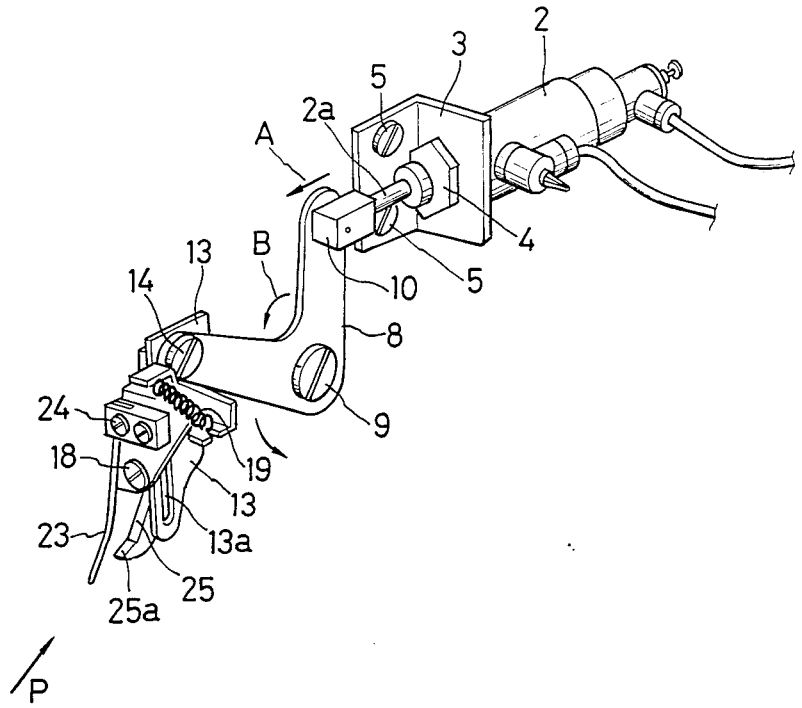
FIG. 2 is a perspective view of one embodiment of an apparatus for turning over a garment flap according to the present invention. Only the right half is shown because the left half is symmetrical.

When the stitch line $S_2$ is completed the pneumatic cylinder 2 expands and cylinder rod 2*a* moves in the direction of arrow A as shown in FIG. 2.

The drive lever 8 rotates in the direction of arrow B as shown in FIG. 2. Slider 15 slides along the oblong hole 13*b*.

As the slider 15 in FIG. 3A shifts it moves into the position shown in FIG. 3B.

At the same time the drive plate 17 descends because it is connected to the slider 15. Eventually the corner recess 17*a* engages the tip 25*a* of the stopper 25 as shown in FIG. 3B.

At this point the tip 23*a* of the flap lever 23 is located slightly above the surface of workpiece T and positioned closely beside the flap $W_f$ as shown in FIG. 3B.

The drive lever 8 then further rotates in the direction of B as shown in FIG. 2, and the slider 15 slides further downward.

Finally, the drive plate 17 rotates clockwise around shaft 18 as shown in FIG. 3C, because the corner recess 17*a* of drive plate 17 has engaged the tip 25*a* of stopper 25.

Thus, the tip 23*a* of the flap lever 23 rotates around the contact point 25*b* between the tip 25*a* and the corner recess 17*a*.

Figure 6:
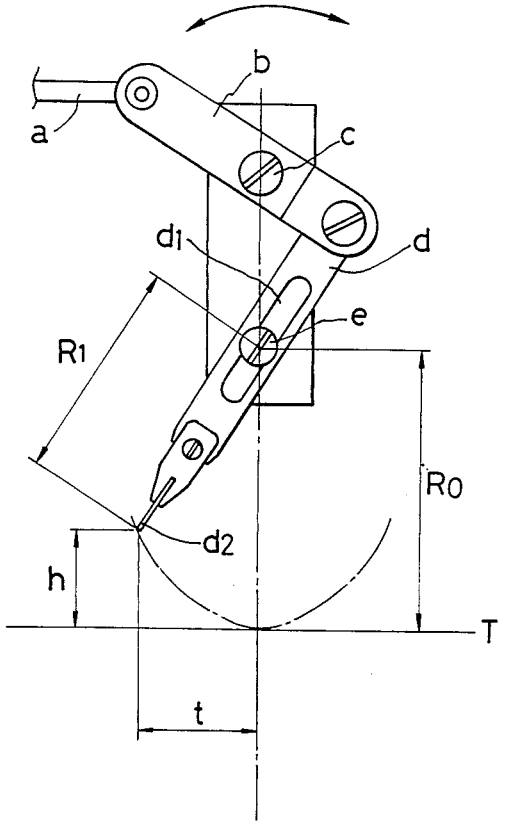
FIG. 6 (PRIOR ART)

Since the tip 23*a* of the flap lever 23 traces a circular curve, the tip 23*a* will not be lifted as high as in the conventional method of rotating the flap lever which has the tip trace a parabolic curve as shown in FIG. 6. The flap $W_f$ will not easily escape from the tip 23*a* of the flap lever 23 even when the garment material is very soft.

Because many different embodiments of the instant invention may be made without departing from the spirit and scope of this disclosure, it is to be understood that the present invention is not limited to the specific embodiment described herein except as defined in the appended claims.

What is claimed is:

1. A flap turning apparatus capable of turning a flap on a garment surface for use on a sewing machine, comprising:

a lever having a tip which when lowered and rotated turns the flap;

a tip shifting mechanism which includes, a set plate;

an "L" shaped lever rotatably attached to said set plate which can rotate about a pivot axis passing through its corner and perpendicular to said set plate;

an actuator connected to said set plate and connected to said "L" shaped lever which when actuated causes said "L" shaped lever to pivot about a horizontal axis;

a guide setting plate which is attached to said set plate;

a guide plate having a vertically elongated slot which is rigidly attached to said guide setting plate;

a slider which is slidably mounted in the guide plate and movably affixed to said "L" shaped lever such that as the "L" shaped lever pivots about the horizontal axis the slider moves along the vertically elongated slot in the guide plate;

a tip rotating mechanism which includes, said set plate;

said guide setting plate, which is attached to said set plate;

a first stopper having a rotation tip which projects beyond said guide setting plate, said first stopper being attached to said guide setting plate;

a drive plate which is pivotally attached to said tip shifting mechanism so that after said tip has descended to close proximity with said garment flap said drive plate contacts said rotation tip so that as said drive plate continues to descend, said drive plate rotates about said rotation tip and around a rotation axis which is orthogonal to both said horizontal axis and said vertically elongated slot, said drive plate having a rotation stopper which prevents rotation of said drive plate beyond a certain point;

a third stopper which limits rotation of said drive plate in the reverse direction of rotation about said rotation axis; and, a means for urging said drive plate to pivot so that said first stopper contacts said drive plate and prevents further rotation of said drive plate.

2. A flap-turning apparatus for use on a sewing machine as in claim 1 wherein said actuator is a pneumatic cylinder.

3. A flap-turning apparatus for use on a sewing machine as in claim 1 wherein said actuator is an electrically operated solenoid.

4. A flap-turning apparatus for use on a sewing machine as in claim 1 wherein said means for urging is a spring.

* * * * *